US008159514B2

(12) United States Patent
Takizawa et al.

(10) Patent No.: US 8,159,514 B2
(45) Date of Patent: Apr. 17, 2012

(54) PRINTING APPARATUS

(75) Inventors: Naoki Takizawa, Kanagawa (JP); Hideki Ando, Kanagawa (JP)

(73) Assignee: Sony Corporation, Tokyo (JP)

( * ) Notice: Subject to any disclaimer, the term of this patent is extended or adjusted under 35 U.S.C. 154(b) by 160 days.

(21) Appl. No.: 12/784,619

(22) Filed: May 21, 2010

(65) Prior Publication Data

US 2010/0309276 A1 Dec. 9, 2010

(30) Foreign Application Priority Data

Jun. 5, 2009 (JP) ..... 2009-135667

(51) Int. Cl.
*B41J 2/325* (2006.01)

(52) U.S. Cl. ..... 347/215

(58) Field of Classification Search ..... 347/215, 347/218, 221, 171; 271/9.07, 9.05, 9.02, 271/9.01; 358/296
See application file for complete search history.

(56) References Cited

U.S. PATENT DOCUMENTS 4,896,167 A * 1/1990 Hayakawa ..... 347/215
5,080,343 A * 1/1992 Kushima et al. ..... 271/9.07
5,379,055 A * 1/1995 Yoshida et al. ..... 347/215
5,534,908 A * 7/1996 Takeda et al. ..... 347/215
6,018,356 A * 1/2000 Morimura et al. ..... 347/215

FOREIGN PATENT DOCUMENTS

JP 3075885 6/2000

* cited by examiner

*Primary Examiner* — Kristal Feggins
(74) *Attorney, Agent, or Firm* — SNR Denton US LLP

(57) ABSTRACT

A printing apparatus includes an image transfer unit thermally transferring a plurality of color materials onto a recording medium to superimpose images in respective color materials, a medium conveyance unit conveying the recording medium through the image transfer unit using a stepper motor, a synchronism loss detection sensor detecting a loss of synchronism with the stepper motor, a reference position detection sensor detecting that the recording medium is located at a predetermined reference position, and a conveyance control unit making the medium conveyance unit repeat a forward conveyance and a reverse conveyance of the recording medium and, if the loss of synchronism is detected in the repeating process, making the image transfer unit resume the color printing on the recording medium through positioning the recording medium to the reference position and conveying the recording medium from the reference position to the transfer start position.

9 Claims, 6 Drawing Sheets

PRINTING APPARATUS

BACKGROUND OF THE INVENTION

1. Field of the Invention

The present invention relates to a printing apparatus performing color printing by thermal transfer.

2. Description of the Related Art

Printing apparatuses based on a thermal transfer technology such as a dye-sublimation method, a thermal fusion method, or a heat-sensitive method have been widely used. A thermal transfer printing apparatus based on, for example, the dye-sublimation method is configured to perform color printing by heating ink to sublimation, so it can adjust the amount of ink by precisely controlling heat quantity, resulting in an image quality nearly as high as that of a photograph.

As an example of such a printing apparatus based on the thermal transfer technology, a line thermal printer has been proposed. The line thermal printer includes a thermal head in which a plurality of heater elements (resistive elements) are linearly arranged. Electric power is selectively applied to the plurality of heater elements in the thermal head depending on a gradation level, and the resulting thermal energy is used to print an image on a recording medium such as printing paper or a printing film. More specifically, the thermal head is configured to descend toward a platen arranged to oppose the thermal head, thereby nipping an ink ribbon and the recording medium conveyed between them. Electric power is selectively applied to the heater elements in the thermal head and the ink on the ink ribbon is heated to sublimation and transferred onto the recording medium, thereby performing the printing on the recording medium.

At this time, the thermal transfer of the ink onto the recording medium is performed on a unicolor basis. Therefore, the line thermal printer controls conveyance of the recording medium to reversely transfer the recording medium to a position at which the transfer started every time color of ink to be thermally transferred is changed.

A forward conveyance and a reverse conveyance of the recording medium are performed by various conveyance rollers arranged in a conveyance path rotating forward or backward in a state of nipping the recording medium. As a drive source of the rollers, a stepper motor is generally used. This is because the use of the stepper motor facilitates drive control and enables a precise drive operation.

That is, the line thermal printer generally prints an image by driving the stepper motor based on control data in which the number of pulses, a drive frequency, and the like are set in advance, conveying the medium precisely (forward and backward) by the drive of the stepper motor, and driving the thermal head at the same time. As a result of employing the stepper motor driven by the control data, the line thermal printer may not detect a transfer start position and a transfer end position of the recording medium to be performed with respect to each color anymore to realize a sequential conveyance operation, thereby reducing a printing time.

The thermal printer that performs the color printing by thermal transfer using a plurality of colors may be disadvantageous in that the recording medium is extended or shrunk in a sub-scanning direction by the heat generated at the time of directly heating the recording medium for the thermal transfer of each color. Generation of such an extension and a shrink may cause a degradation of quality of a formed image because of registration deviations among images formed on the recording medium in respective colors. In this regard, there is proposed a technology of reducing the registration deviations caused by the extension and the shrink of the recording medium by changing the transfer start position in a sub-scanning direction depending on the amount by which the recording medium extends or shrinks at the time of the thermal transfer of each color in the thermal printer when the thermal transfer is performed in the plurality of colors (see, for example, Japanese Patent No. 3075885).

SUMMARY OF THE INVENTION

A stepper motor used as the drive source for the forward conveyance and the reverse conveyance of the recording medium may involve a risk of becoming uncontrollable due to loss of synchronism. The loss of synchronism of the stepper motor is more likely to occur in a state where a conveyance load of the recording medium exceeds the driving ability of the stepper motor or where the conveyance load is very likely to change, for example, when a mechanical section is badly worn, and when a state (thickness, size, curl, or the like) of the recording medium is uneven or inappropriate. An instable power supply can cause the loss of synchronism. Especially such a printer that can use roll paper, which grew popular recently, as the recording medium, is configured to frequently induce the loss of synchronism because the conveyance load keeps changing due to factors unique to the roll paper, including changes in a level of loosening, a diameter of the roll, or a weight of the roll according to consumption of the roll paper.

Frequency of the loss of synchronism of such a stepper motor can be reduced by employing a motor having a sufficient torque margin. However, this technique disadvantageously increases the size and the production cost of the printer and will not exhibit any effect on the issue of the power supply described above.

In short, it is difficult to make sure to avoid the occurrence of the loss of synchronism in the stepper motor.

When the loss of synchronism occurs in the stepper motor, in general, the thermal printer using the stepper motor as the drive source issues an error notice and stops the printing operation so as to prevent a printing failure or a paper jam as far as possible. However, the thermal printer configured to issue the error notice and stop the printing operation leaves processing operations after the occurrence of the loss of synchronism including an understanding of the status and a reset process to a user of the thermal printer. Therefore, the processing operation after the occurrence of the loss of synchronism is not necessarily performed in an effective way, and the configuration may not be friendly to the user.

This issue is not avoided by changing the transfer start position with respect to each color depending on the extended or shrunk amount of the recording medium as disclosed in Japanese Patent No. 3075885 described above.

Therefore, it is desirable to provide a printing apparatus capable of continuing a printing operation in progress even if the stepper motor becomes uncontrollable due to the loss of synchronism during the color printing by thermal transfer, thereby performing an efficient and user-friendly color printing.

According to an embodiment of the present invention, a printing apparatus includes an image transfer unit configured to perform a color printing on a recording medium by thermally transferring a plurality of color materials onto the recording medium in a sequential manner thereby superimposing images in respective color materials, a medium conveyance unit configured to convey the recording medium using a stepper motor as a drive source so that the recording medium passes through the image transfer unit, a synchronism loss detection sensor configured to detect an occurrence of a loss of synchronism in the stepper motor, a reference position detection sensor configured to detect that the recording medium conveyed by the medium conveyance unit is located at a predetermined reference position, and a conveyance control unit configured to make the medium conveyance unit repeat a forward conveyance of the recording medium from a transfer start position located at a predetermined distance from the reference position and a reverse conveyance of the recording medium to the transfer start position for each of the color materials when the image transfer unit performs the color printing, and, if the synchronism loss detection sensor detects the loss of synchronism in a process of the repeating, make the image transfer unit resume the color printing on the recording medium interrupted by the loss of synchronism through positioning the recording medium in the repeating process to the reference position using a detection result of the reference position detection sensor and conveying the recording medium in the repeating process from the reference position to the transfer start position.

With the printing apparatus configured as above, when the loss of synchronism of the stepper motor is detected in the process of repeating the forward conveyance of the recording medium from the transfer start position and the reverse conveyance to the transfer start position with respect to each color material, the recording medium in the repeating process is positioned to the reference position. After the positioning, the recording medium is conveyed to the transfer start position located at the predetermined distance from the reference position. By doing so, even if the stepper motor becomes uncontrollable due to the loss of synchronism, i.e., even if the location of the recording medium may not be found due to the loss of synchronism, the recording medium returns to the transfer start position without fail. After that, the color printing on the recording medium that was once interrupted by the loss of synchronism is resumed. That is, the processing operation for the color printing after the occurrence of the loss of synchronism is continued. At this time, the recording medium has returned to the transfer start position through positioning to the reference position. Therefore, even when the color printing is resumed after the interruption by the loss of synchronism, the transfer start position for each color remains the same before and after the occurrence of the loss of synchronism.

According to the embodiment of the present invention, when the color printing by the thermal transfer is performed, even if the stepper motor becomes uncontrollable due to the loss of synchronism, the printing in progress can be continued. That is, the printing operation does not stop even if the stepper motor loses synchronism, and a printing result without any color shift can be obtained despite having continued the printing operation in progress. Accordingly, the processing operation after the occurrence of the loss of synchronism in the stepper motor can be performed efficiently, and therefore the user-friendliness is improved. Furthermore, because a stepper motor with less torque margin that is likely to cause the loss of synchronism can be used, a smaller motor can be selected compared with a configuration to issue an error notice or stop the printing operation in response to the loss of synchronism, advantageously resulting in the reduction of the size, the weight, and the production cost of the device.

DESCRIPTION OF THE PREFERRED EMBODIMENTS

A mode for carrying out the present invention (referred to below as an embodiment) will be described below in the following order.

1. An example of a general configuration of a printing apparatus according to an embodiment of the present invention
2. An example of a processing operation performed by the printing apparatus according to the embodiment of the present invention <1. An Example of a General Configuration of a Printing Apparatus According to an Embodiment of the Present Invention>

An explanation is given below taking a dye-sublimation thermal printer device as an example of a printing apparatus according to an embodiment of the present invention. The dye-sublimation thermal printer device (referred to below simply as a printer device) is configured to print an image by sublimating sublimation dye applied to an ink ribbon and transferring it onto a recording medium using thermal energy generated when electric power is applied to heater elements in a thermal head. Roll paper may be used as the recording medium. The roll paper is contained in a roll paper holder in a roll shape to be drawn out of the holder and conveyed as necessary.

[Exemplary Configuration of Roll Paper Conveyance Path]

Figure 1:
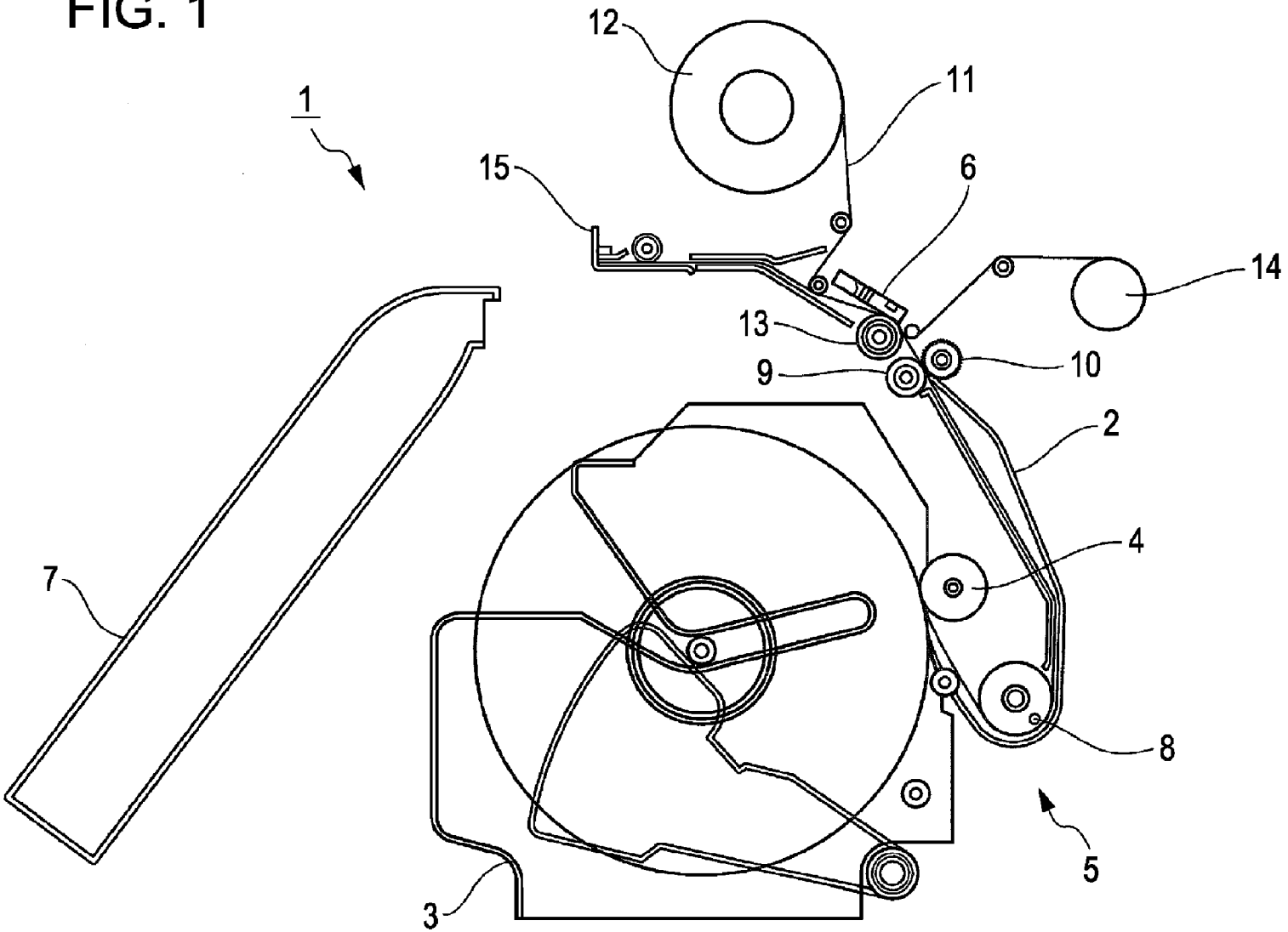
FIG. 1 is a sectional side view of an exemplary configuration of a roll paper conveyance path in a printer device according to an embodiment of the present invention.

FIG. 1 is a sectional side view of an exemplary configuration of a roll paper conveyance path in a printer device 1 according to the embodiment of the present invention. The roll paper conveyance path in the printer device 1 shown in FIG. 1 is configured as described below.

A roll paper (recording medium) 2 held by a paper holder 3 is fed by a feed roller 4 to a thermal head 6 via a return section 5. The return section 5 is a substantially U-shaped path configured to change the direction of the entered roll paper 2 and discharge the roll paper 2. By incorporating the return section 5, a limited space in the printer device 1 can be effectively utilized and the paper holder 3 and a receiving tray 7 can be arranged on the same side (front side of the device), thereby improving the usability. The path in the return section 5 is bending in a direction opposite to a curl of the roll paper 2 so that the curl is corrected when the roll paper 2 passes through it. A return roller 8 is disposed on an inner side of the return section 5. By rotating the return roller 8, the roll paper 2 fed to it can be smoothly conveyed even in such a bending path.

A capstan 9 and a pinch roller 10 are disposed near the thermal head 6. The roll paper 2 is reliably nipped between the capstan 9 and the pinch roller 10. A precise conveyance is performed by driving the capstan 9 corresponding to a printing operation.

Thus, the roll paper 2 can be freely conveyed through the conveyance path by drive of a medium conveyance unit including the feed roller 4, the return roller 8, and the capstan 9.

An ink ribbon (ribbon-shaped member) 11 in each color is housed in a ribbon cassette, which is drawn by a supply reel 12 and guided by various guide rollers passing on a platen 13 for printing to be sequentially discharged onto a winding reel 14.

At the time of printing, the thermal head 6 approaches from its waiting position and nips the roll paper 2 along with the ink ribbon 11 in a state of being pressed against the platen 13. When gradation data of an image to be printed is input in this state, the printer device 1 selectively drives heater elements in the thermal head 6 to sublimate the ink on the ink ribbon 11 while conveying the roll paper 2, thereby transferring the image onto the roll paper 2. In other words, the ink serving as a color material is thermally transferred onto the roll paper 2 to form the image on the roll paper 2. By repeating this with respect to each color of ink to be transferred, a color printing is performed.

Thus, the color printing is performed on the roll paper 2 by an operation of an image transfer unit including the thermal head 6, the ink ribbon 11, and the platen 13.

The roll paper 2 printed with the image is cut by a cutter unit 15 to a predetermined size, and discharged to the receiving tray 7 through a paper port.

[Exemplary Configuration of Drive Mechanism of Medium Conveyance Unit]

Figure 2:
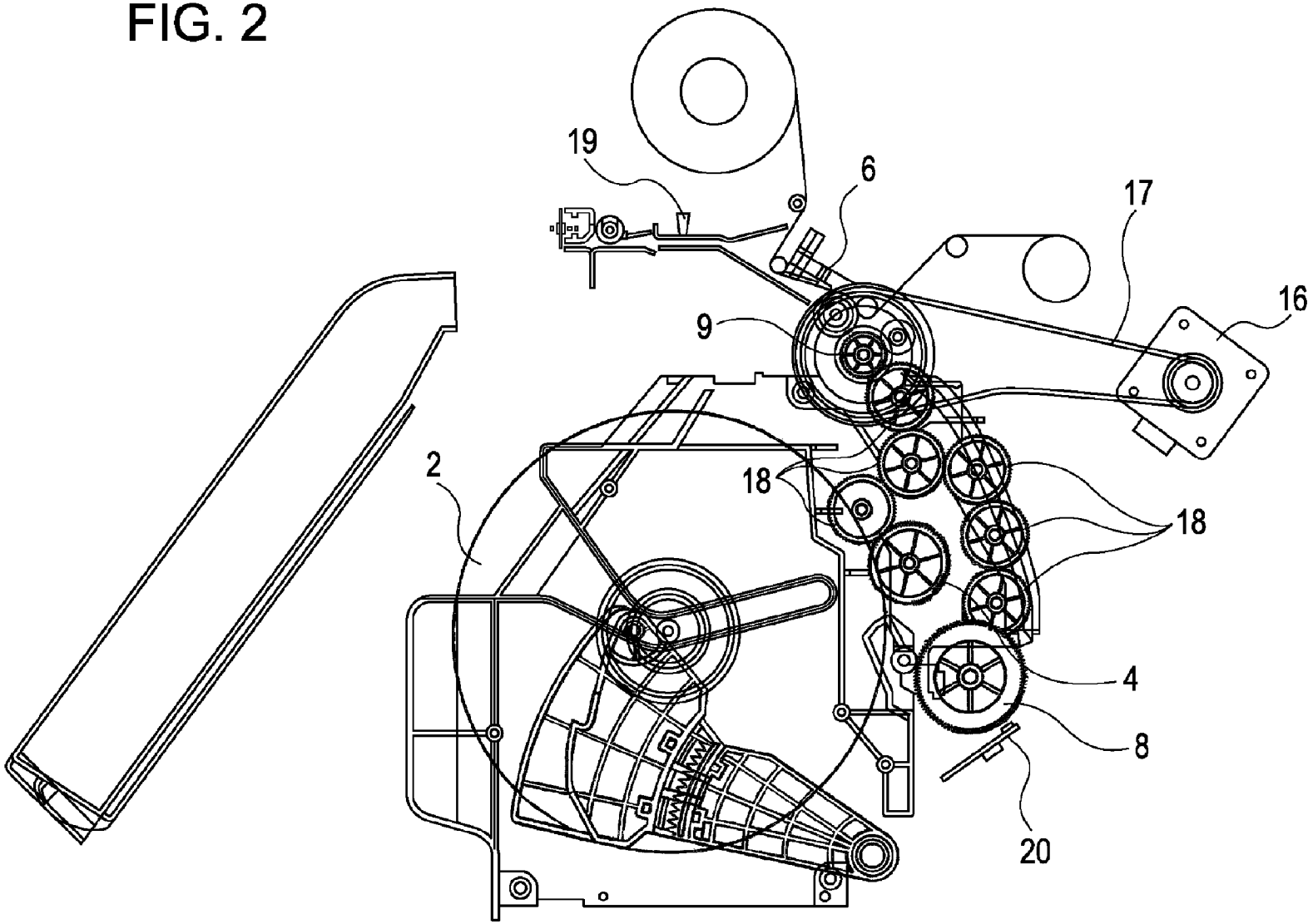
FIG. 2 is a sectional side view of an exemplary configuration of a drive mechanism of a medium conveyance unit in the printer device according to the embodiment of the present invention.

FIG. 2 is a sectional side view of an exemplary configuration of a drive mechanism of a medium conveyance unit (the feed roller 4, the return roller 8, and the capstan 9) in the printer device 1 according to the embodiment of the present invention.

In the drive mechanism shown in FIG. 2, all of constituents that form the medium conveyance unit are connected to a stepper motor 16 serving as a common drive source to be driven.

A power of the stepper motor 16 is transmitted by a drive belt 17 to the capstan 9 first and then to the feed roller 4 and the return roller 8 by interposing an idler gear 18 for interlocking. Accordingly, all the constituents of the medium conveyance unit can be driven in synchronization and a precise rotation control in both forward and reverse directions can be performed by the stepper motor 16.

The stepper motor 16 that drives the constituents of the medium conveyance unit is controlled based on an input drive pulse. Therefore, a rotation direction, a rotation speed, the number of revolutions, and the like can be controlled by the control data in which the number of pulses, a drive frequency, and the like are set in advance without using any feedback circuit. By employing the stepper motor 16, detecting a paper position and a paper feeding speed performed for each color transfer is eliminated, thereby advantageously simplifying a hardware configuration and reducing a printing time.

Specifically, the stepper motor 16 is controlled as described below. In this embodiment, in a state where a cueing of the roll paper 2 is completed, the printer device 1 is programmed to automatically convey the roll paper 2 at the direction, the speed, a distance, and a timing set in advance, and to transfer the image according to the conveyance.

More specifically, the cueing of the roll paper 2 can be performed by detecting a front end of the roll paper 2 using a paper position detection sensor 19 disposed downstream of the thermal head 6. Thus, it is detected that the roll paper 2 is positioned at a predetermined reference position, and the cueing is completed. That is, the paper position detection sensor 19 serves as a reference position detection sensor for detecting that the roll paper 2 is in the reference position.

Once the cueing is completed, the roll paper 2 moves based on the control data set in advance. That is, starting from the state in which the roll paper 2 is in the reference position, a positioning is performed according to the size of the roll paper 2 or the like. Thus, the roll paper 2 moves from the reference position to a transfer start position away from the reference position by a predetermined distance. When the roll paper 2 is set to the transfer start position, a transfer is performed using the ink ribbon 11 of the first color (for example, yellow). In the configuration according to the embodiment, a pullback printing method is employed, in which the transfer is performed when the roll paper 2 is pulled back from the transfer start position to an upstream side of a direction in which the roll paper 2 is conveyed. When the transfer of the first color is terminated, the roll paper 2 is set at the transfer start position again based on the control data, and the transfer of the second color (for example, magenta) is performed. After that, the transfer of the third color (for example, cyan) and also a lamination process are similarly performed when the roll paper repeats reciprocations.

[Exemplary Configuration of Synchronism Loss Detection Sensor in Stepper Motor]

The printer device 1 according to the embodiment includes a synchronism loss recovery control unit. The synchronism loss recovery control unit is used to prevent the printing operation from stopping even if the stepper motor 16 serving as the drive source of the medium conveyance unit loses synchronism, and to provide a printing result without any color shift despite having continued the printing operation in progress. To form the synchronism loss recovery control unit, the medium conveyance unit is provided with a synchronism loss detection sensor 20.

Figure 3:
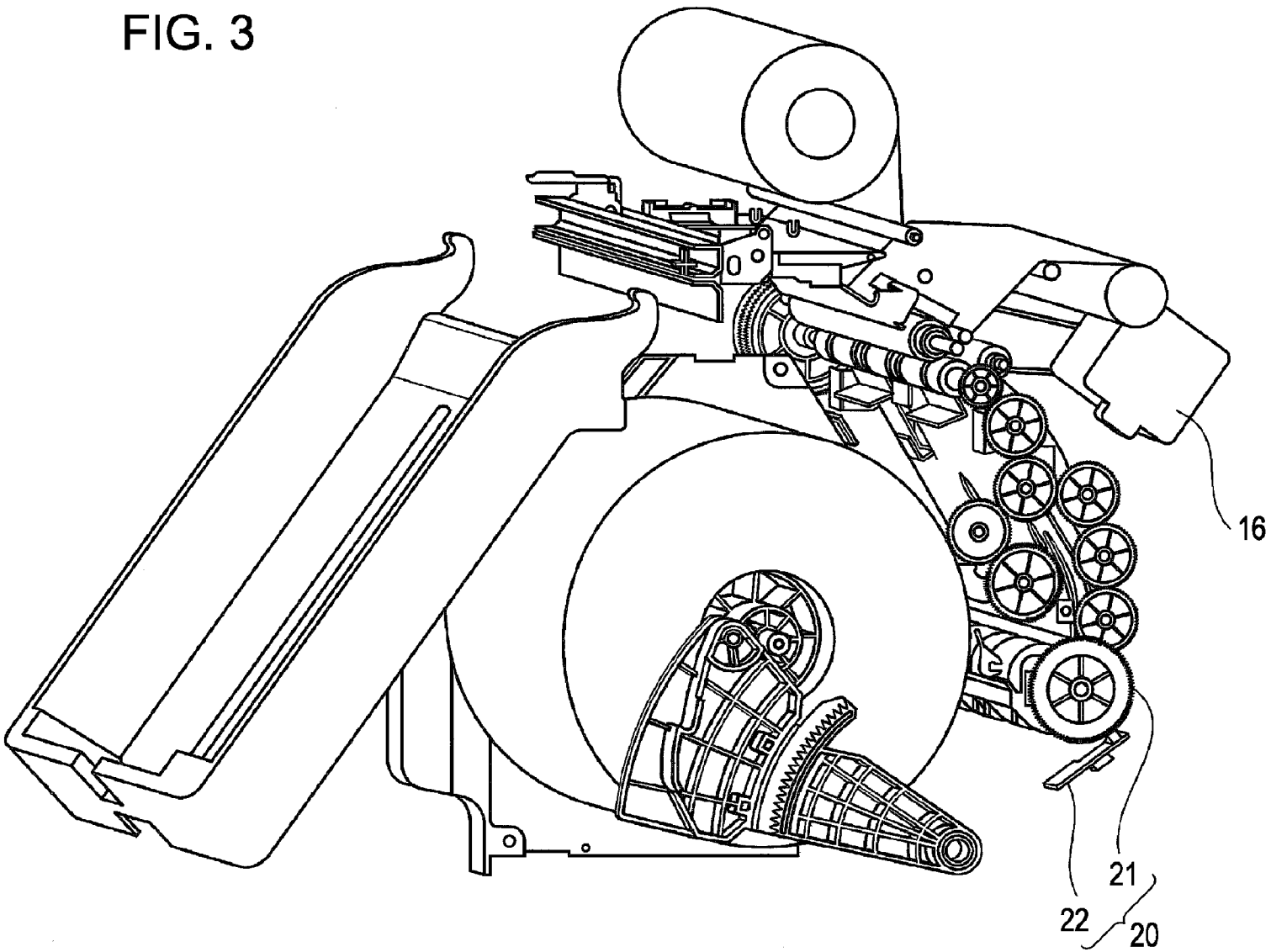
FIG. 3 is a perspective view of an exemplary configuration of a synchronism loss detection sensor in the printer device according to the embodiment of the present invention.

FIG. 3 is a perspective view of an exemplary configuration of the synchronism loss detection sensor 20 in the printer device 1 according to the embodiment of the present invention.

The synchronism loss detection sensor 20 shown in FIG. 3 is attached to the return roller 8 in the medium conveyance unit, and it is configured to monitor rotation of the return roller 8. More specifically, the synchronism loss detection sensor 20 generally includes an encoder 21 that rotates in accordance with the return roller 8 and a photosensor 22 that reads the rotation and generates a frequency generator (FG) pulse. The rotation speed, the number of revolutions, and the like of the return roller 8 can be computed based on the FG pulse and, as a result, an occurrence of the loss of synchronism in the stepper motor 16 can be detected.

The configuration of the synchronism loss detection sensor 20 is not limited to the above example, and other related technologies may be used.

[Exemplary Configuration of Conveyance Control Unit Performing Synchronism Loss Detection and Conveyance Control Based on Result of Detection]

Figure 4:
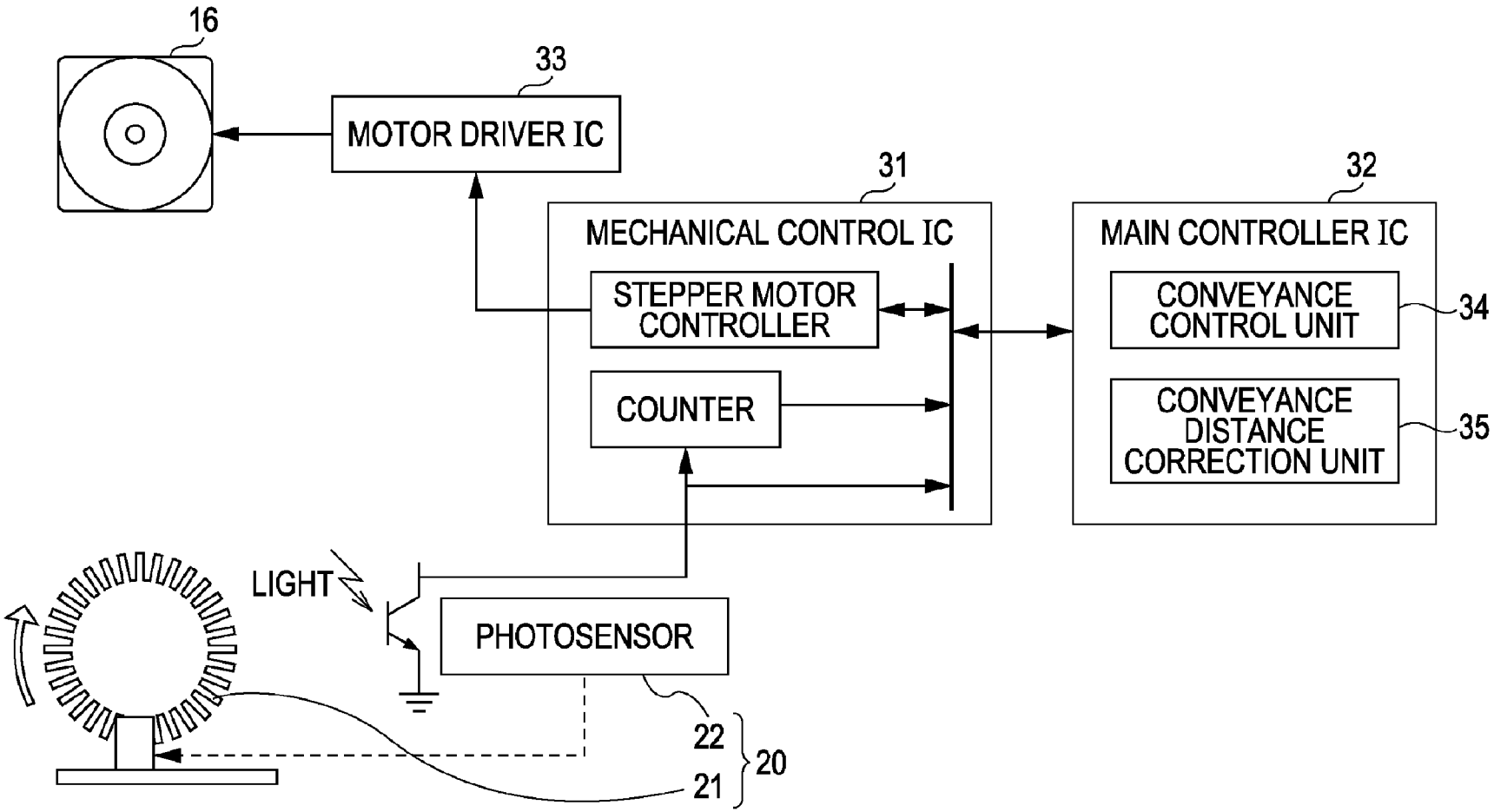
FIG. 4 is a functional block diagram of an exemplary configuration of a control system performing synchronism loss detection and a conveyance control based on a result of the detection in the printer device according to the embodiment of the present invention.

FIG. 4 is a functional block diagram of an exemplary configuration of a control system performing a synchronism loss detection and a conveyance control based on a result of the detection in the printer device 1 according to the embodiment of the present invention.

In a flow of a signal processing performed by the control system configured as shown in FIG. 4, a signal from the photosensor 22 is input to a mechanical control integrated circuit (IC) 31 to count the number of FG pulses. The counted number is passed to a main controller IC 32 along with an actual sensor signal. The main controller IC 32 determines whether the stepper motor 16 lost synchronism based on the conveyance distance of the roll paper 2 computed from the speed and the number the FG pulses.

The main controller IC 32 provides a motor driver IC 33 with a drive pulse to drive the stepper motor 16 through a stepper motor controller included in the mechanical control IC 31 based on the control data set in advance. This results in performing a drive control as detailed later on the stepper motor 16. The drive control on the stepper motor 16 is realized by functions of a conveyance control unit 34 and a conveyance distance correction unit 35 included in the main controller IC 32.

The configuration of the control system is not limited to the above example, and other related technologies may be used as long as the functions of the conveyance control unit 34 and the conveyance distance correction unit 35 can be realized.

<2. An Example of a Processing Operation Performed by the Printing Apparatus According to the Embodiment of the Present Invention>

An example of a processing operation performed by the printer device 1 configured as described above is explained below.

[Summary of Conveyance Control]

Figure 5:
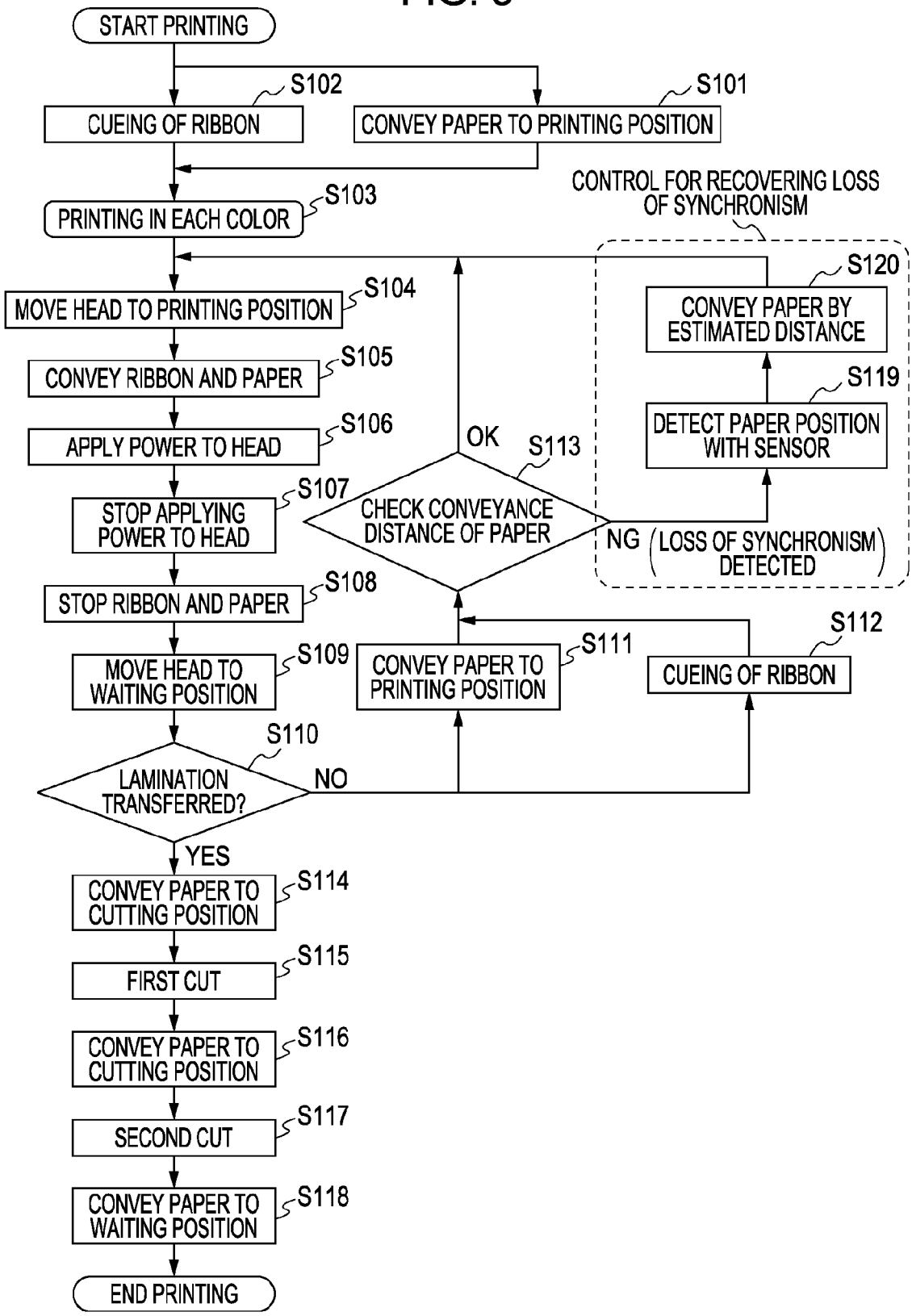
FIG. 5 is a flowchart of an exemplary conveyance control performed by the printer device according to the embodiment of the present invention.

FIG. 5 is a flowchart of an exemplary conveyance control performed by the printer device 1 according to the embodiment of the present invention.

To print an image using the printer device 1, the conveyance control unit 34 and the conveyance distance correction unit 35 perform the conveyance control on the roll paper 2 in a procedure described below.

First, a portion used as the transfer start position of the roll paper 2 is set immediately beneath the thermal head 6 (Step S101). The roll paper 2 is set differently depending on the state of the printer device 1 at the time of starting printing. For example, in a state where the cueing of the roll paper 2 is completed, the roll paper 2 is conveyed in the downstream direction by the predetermined distance based on the control data. Alternatively, in a state where the cueing of the roll paper 2 is not completed like a case of printing the first sheet after the power is turned on, the roll paper 2 is conveyed in the downstream direction by the predetermined distance after the paper position detection sensor 19 detects the front end of the roll paper and completes the cueing of the roll paper 2.

On the other hand, the cueing of the ink ribbon 11 is performed in parallel (Step S102), the ink ribbon 11 is fed so that a top portion of an ink area of the first color is set immediately beneath the thermal head 6.

After setting the roll paper 2 to the transfer start position and cueing the ink ribbon 11, the printing is initiated with respect to each color (Step S103).

To start printing in each color, the thermal head 6 is moved down to a printing position in a state where the roll paper 2 and the ink ribbon 11 are set (Step S104). While performing the reverse conveyance (pullback) of the roll paper 2 and the feeding of the ink ribbon 11 based on the control data (Step S105), electric power is applied to the thermal head 6 (Step S106), thereby transferring ink (first color) onto the roll paper 2. Upon completion of the transfer, the electric power applied to the thermal head 6 is turned off (Step S107), the reverse conveyance of the roll paper 2 and the feeding of the ink ribbon 11 are terminated (Step S108), and the thermal head 6 is raised to the waiting position (Step S109).

It is now determined whether a lamination to be transferred in the final process has been transferred from the ink ribbon 11 to the roll paper 2 (Step S110), and when the lamination is not transferred, a process for transferring the next color is performed. Specifically, to transfer the next color, the roll paper 2 is conveyed in the downstream direction based on the control data, and the portion used as the transfer start position of the roll paper 2 is set again immediately beneath the thermal head 6 (Step S111). As in the transfer of the first color, the cueing of the ink ribbon 11 is also performed in parallel (Step S112).

Before starting a transferring operation of the next color, the conveyance distance of the roll paper 2 is checked with reference to an output from the synchronism loss detection sensor 20 (Step S113). As a result of the check, if the conveyance distance is fine, it is determined that the portion corresponding to the transfer start position of the roll paper 2 is set immediately beneath the thermal head 6 without problem, and the process moves to the transferring operation of the next color.

When the transferring operations of all colors (yellow, magenta, and cyan) and the lamination process are completed through the series of processing operations (Step S110), the roll paper 2 is conveyed to a position of the cutter unit 15 based on the control data (Step S114). After cutting the front end of an area in which an image is transferred (Step S115), the roll paper 2 is conveyed (Step S116) and a rear end of the same is cut (Step S117). After cutting the rear end, the roll paper 2 is returned to the upstream side to prepare for the next printing operation (Step S118). In the series of processing to this point, the stepper motor is driven based on the control data set in advance (except cueing). In other words, the roll paper 2 is automatically conveyed in the direction, at the speed, by the distance, and at the timing determined in advance, and the printing is performed.

As a result of checking the conveyance distance of the roll paper 2 based on the output from the synchronism loss detection sensor 20 (Step S113), if the conveyance distance specified to the stepper motor 16 does not match the conveyance distance actually detected by the synchronism loss detection sensor 20, it means there is a problem with the conveyance distance of the roll paper 2 causing the loss of synchronism in the stepper motor 16.

When the loss of synchronism occurs in the stepper motor 16, the stepper motor 16 may not be correctly controlled based on the control data as described above. That is, the roll paper 2 and the ink ribbon 11 may not be set to the transfer start position for transferring the next color.

Therefore, if it is recognized that the loss of synchronism occurred in the stepper motor 16, the paper position detection sensor 19 detects the front end of the roll paper 2 again to complete the cueing of the roll paper 2 (Step S119).

The roll paper 2 is set to the transfer start position from the cued position. However, the conveyance distance of the roll paper 2 at this time is not fixed to a value set in advance but corrected depending on the progress of the printing process to this point (Step S120).

This is because a condition of the curl of the roll paper 2 may be changed by heating and curl correction every time a single color is transferred. In other words, it is because the shift between the previous transfer start position and the current transfer start position caused by the difference of the curl condition of the roll paper 2 can be offset by correcting the conveyance distance of the roll paper 2. As a result, the transfer start position for the next color is adjusted to substantially match the transfer start positions in the past even if the curl condition of the roll paper 2 changes.

More specifically, when the loss of synchronism is found in the stepper motor 16 in the process of repeating the forward conveyance of the roll paper 2 from the transfer start position and the reverse conveyance of the roll paper 2 to the transfer start position with respect to each color, the conveyance control unit 34 positions the roll paper 2 in the repeating process to the reference position through the cueing performed by the paper position detection sensor 19. After the positioning, the roll paper 2 is conveyed to the transfer start position away from the reference position by the predetermined distance. Thus, even when the stepper motor 16 becomes uncontrollable due to the loss of synchronism, i.e., even if it is not detectable where the roll paper 2 is located due to the loss of synchronism, the roll paper 2 returns to the transfer start position. The conveyance control unit 34 then resumes the color printing on the roll paper 2 that was once disrupted by the loss of synchronism. In other words, the processing operation for the color printing after the occurrence of the loss of synchronism is continuously performed. At this time the roll paper 2 is returned to the transfer start position through the positioning to the reference position. Therefore, even when the color printing is resumed after the disruption due to the loss of synchronism, the transfer start position for each color remains the same before and after the occurrence of the loss of synchronism.

Furthermore, when the roll paper 2 is set again to the transfer start position through the cueing performed by the paper position detection sensor 19, the conveyance distance correction unit 35 corrects the conveyance distance of the roll paper 2 depending on the progress of the printing performed so far. Therefore, even in a case where the curl condition of the roll paper 2 changes due to the heating and the curl correction every time a single color is transferred, the shift between the previous transfer start position and the current transfer start position caused by the difference of the curl condition of the roll paper 2 can be offset by the correction. In other words, by the conveyance distance correction unit 35 correcting the position depending on the progress of the printing, the transfer start position of the roll paper 2 can be set to the transfer start position for the first color, thereby enabling the printing under progress to continue without any color shift.

[Example of Correcting Conveyance Distance]

A specific example is given below to explain position correction performed by the conveyance distance correction unit 35 depending on the progress of the printing.

The conveyance distance correction unit 35 computes a correction distance for correcting the conveyance distance using an arithmetic expression set in advance. Specifically, the correction distance is computed using, for example, Equation (1) below.

$$Lc=\{(a\times Dy+b\times Dm+c\times Dc)\times Dt+Dp\}\times Ds \quad (1)$$

In Equation (1), Lc is the correction distance to be obtained from the computation. The conveyance distance correction unit 35 corrects the conveyance distance of the roll paper 2 based on the correction distance Lc.

Dy, Dm, and Dc are average printing densities of the respective colors (yellow, magenta, and cyan). The average printing density can be computed from a value of the gradation data of the image to be printed. Characters a, b, and c are correction factors of the respective colors. The correction factor is used to correct the difference of thermal energy at the time of printing caused by the difference of color developing characteristics among the colors. Therefore, by multiplying the correction factor by the average printing density, the thermal energy supplied from the thermal head 6 to the roll paper 2 can be estimated using the average printing density of each color material thermally transferred by the thermal head 6 from when each color is printed until the synchronism loss detection sensor 20 detects the loss of synchronism. By including terms of Dy, Dm, Dc, a, b, and c, Equation (1) can correct the conveyance distance of the roll paper 2 based on the thermal energy supplied from the thermal head 6 to the roll paper 2 before the synchronism loss detection sensor 20 detects the loss of synchronism. The purpose of this is to eliminate an effect of the curl condition of the roll paper 2 changed by the amount of thermal energy supplied to the roll paper 2 by the correction.

For a color that is not yet printed at the time point when the loss of synchronism occurred, the average printing density is 0. Thus, Equation (1) reflects a degree of the progress of the thermal transfer with respect to each color material having been performed by the thermal head 6 (a degree to which color the thermal transfer has been performed) at the time of detecting the loss of synchronism using the synchronism loss detection sensor 20. That is, while reflecting the degree of the progress of the thermal transfer with respect to each color material, the thermal energy supplied from the thermal head 6 to the roll paper 2 is estimated.

Dt is a correction factor of an ambient temperature. The ambient temperature can be obtained using a temperature sensor provided in the printer device 1. At this time, it is conceivable to use a conversion table of the temperature and the correction factor set in advance. By including the term of Dt, Equation (1) can correct the conveyance distance of the roll paper 2 based on the detection result of the ambient temperature condition in the device at the time of detecting the loss of synchronism using the synchronism loss detection sensor 20. The purpose of this is to eliminate an effect of the curl condition of the roll paper 2 changed by the ambient temperature in the device by the correction.

It is not limited to use the ambient temperature here. In other words, as the environmental condition in the device, both or at least one of the ambient temperature and an ambient humidity can be used.

Dp is a correction factor of a consumed amount in association with the rolled state of the roll paper 2. By including the term of Dp, Equation (1) can correct the conveyance distance of the roll paper 2 based on the consumed amount in association with the rolled state at the time of detecting the loss of synchronism using the synchronism loss detection sensor 20 when the roll paper 2 is pulled out of the rolled state to be supplied. The purpose of this is to eliminate an effect of the curl condition of the roll paper 2 changed by the roll diameter of the roll paper 2 that changes depending on the consumed amount by the correction.

The consumed amount in association with the roll state can be obtained using an exclusive detection sensor provided on the paper holder 3 of the roll paper 2 in the device based on a related art. It is also conceivable to detect a remaining amount instead of the consumed amount, and to compute the consumed amount from the detection result.

Alternately, the exclusive detection sensor may not necessarily be used, and other approaches can be used to obtain the consumed amount in association with the rolled state. For example, if the consumption of the roll paper 2 uniquely corresponds to the consumption of the ink ribbon 11, it is conceivable to estimate the consumed amount in association with the rolled state of the roll paper 2 using the detection result of the consumed amount of the ink ribbon 11. Because printing may not be performed once the ink ribbon 11 runs out, it is general to detect the consumed amount of the ink ribbon 11 using a sensor. Therefore, if the consumed amount in association with the rolled state of the roll paper 2 is estimated from the consumed amount of the ink ribbon 11, the detection result of an existing sensor can be used without providing an exclusive sensor for detecting the consumed amount in association with the rolled state.

In both cases of providing the exclusive sensor for detecting the consumed amount in association with the rolled state and estimating the consumed amount in association with the rolled state of the roll paper 2 from the consumed amount of the ink ribbon 11, it is conceivable to use the conversion table of the consumed amount or the remaining amount and the correction factor set in advance in order to specify the correction factor based on the consumed amount in association with the rolled state.

Ds is a correction factor to make a computation result of the correction distance Lc suitable for a pulse control because the conveyance control unit 34 performs a pulse control on the stepper motor 16. That is, Ds corresponds to the final adjustment factor of the correction.

In a case where the conveyance distance correction is performed using Equation (1) configured as described above, when the roll paper 2 is conveyed to the transfer start position at the predetermined distance from the reference position after the cueing, a correction as described below is to be performed on the conveyance distance (i.e., the number of pulses) corresponding to the predetermined distance.

For example, if the printing densities Dy, Dm, and Dc are high, because more thermal energy is supplied to the roll paper 2 and therefore the roll paper 2 is more likely to curl, the conveyance distance is corrected so as to reduce the conveyance distance corresponding to the predetermined distance to eliminate the effect by the curl. On the other hand, if the printing densities Dy, Dm, and Dc are low to the contrary, the conveyance distance is corrected so as to increase the conveyance distance corresponding to the predetermined distance.

Furthermore, for example, if the ambient temperature Dt is high, because more thermal energy is supplied to the roll paper 2 and therefore the roll paper 2 is more likely to curl, the conveyance distance is corrected so as to reduce the conveyance distance corresponding to the predetermined distance to eliminate the effect by the curl. On the other hand, if the ambient temperature Dt is low to the contrary, the conveyance distance is corrected so as to increase the conveyance distance corresponding to the predetermined distance.

Moreover, for example, if the consumed amount Dp of the roll paper 2 is large and the remaining amount is small, because the roll diameter is small and therefore the roll paper 2 is more likely to curl, the conveyance distance is corrected so as to reduce the conveyance distance corresponding to the predetermined distance to eliminate the effect by the curl. If the consumed amount Dp of the roll paper 2 is small to the contrary, the conveyance distance is corrected so as to increase the conveyance distance corresponding to the predetermined distance.

[Example of Conveyance Control]

A specific example is given below to explain a conveyance control of the roll paper 2 performed through the correction of the conveyance distance as described above.

Figure 6:
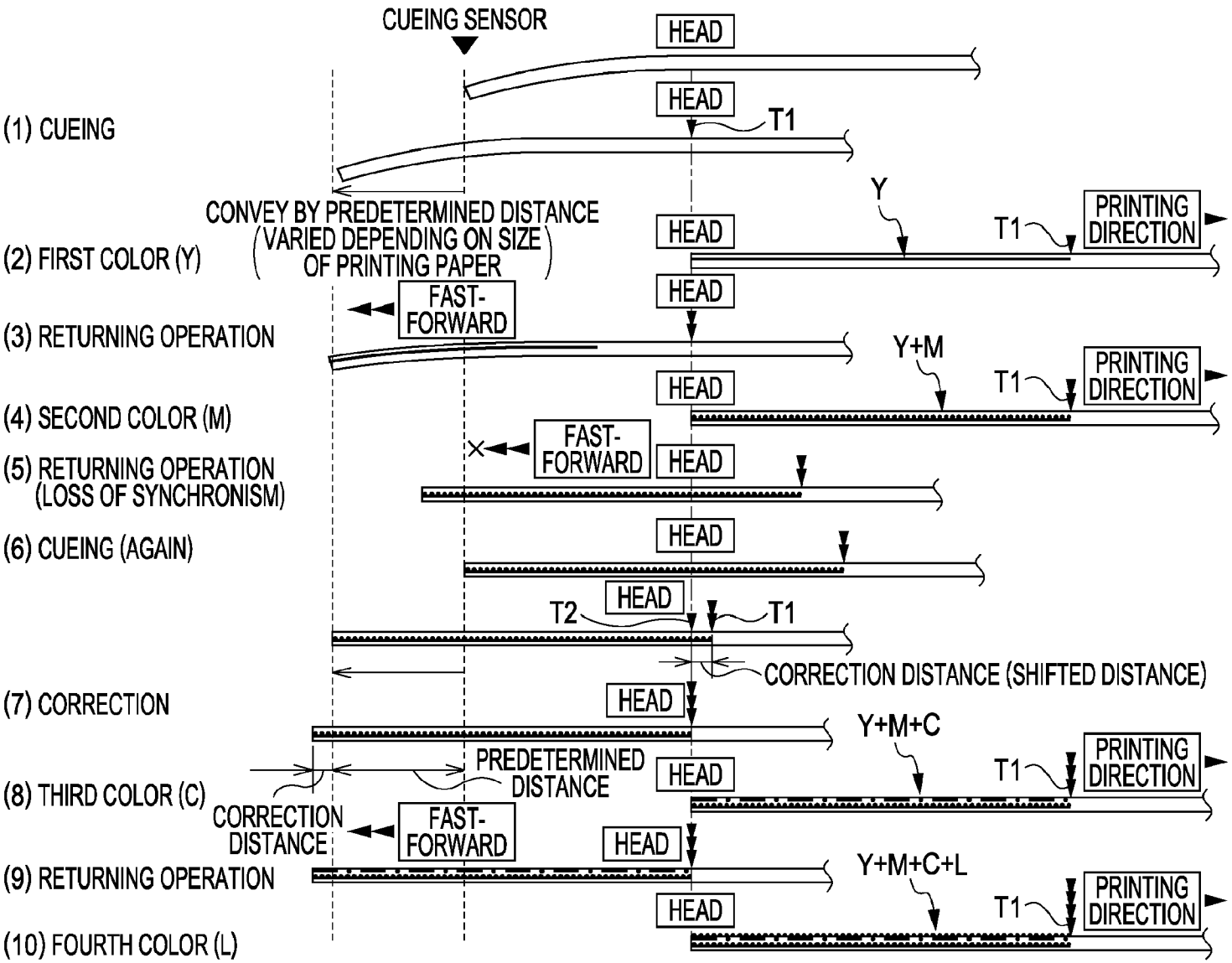
FIG. 6 illustrates an example of correcting a position of roll paper in the printer device according to the embodiment of the present invention.

FIG. 6 illustrates an example of correcting the position of the roll paper 2 in the printer device 1 according to the embodiment of the present invention. FIG. 6 illustrates a case in which the loss of synchronism occurs in the stepper motor 16 after the second color has been transferred.

First, the printer device 1 performs the cueing of the roll paper 2 and the positioning corresponding to the size of the printing paper, and then a transfer start position T1 of the roll paper 2 for the first color is set immediately beneath the thermal head 6 (see (1) in FIG. 6). The transfer start position T1 is also used as the transfer start position for the second and later colors.

The roll paper 2 is then conveyed backward based on the control data, and the first color (yellow) is transferred while pulling the roll paper 2 back toward the upstream side (see (2) in FIG. 6).

The roll paper 2 is conveyed in the downstream direction at a high speed based on the control data, and the transfer start position T1 is set immediately beneath the thermal head 6 again (see (3) in FIG. 6).

After that, the roll paper 2 is conveyed backward again based on the control data, and the second color (magenta) is transferred while pulling the roll paper 2 back toward the upstream side (see (4) in FIG. 6).

The roll paper 2 is conveyed in the downstream direction at a high speed based on the control data, and the transfer start position T1 is set immediately beneath the thermal head 6 again. However, if the loss of synchronism occurs at this time, the positioning to the transfer start position T1 may not be performed correctly, and the transfer start position for the third color is shifted (see (5) in FIG. 6). If the third color is transferred in this state, a printing error will occur. Because switching to such a high-speed conveyance rapidly increases a load on the stepper motor 16, it can be a cause of the loss of synchronism in a case where the torque does not have much margin.

Therefore, when the synchronism loss detection sensor 20 detects the loss of synchronism of the stepper motor 16, the conveyance control unit 34 detects the front end of the roll paper 2 using the paper position detection sensor 19 and performs the cueing of the roll paper 2, thereby positioning the roll paper 2 again (see (6) in FIG. 6).

However, the roll paper 2 has been subjected to the heating and the curl correction during the operations in the past, the degree of the curl has become loose. Therefore, the transfer start position T1 determined based on the cueing performed before the printing is started may be shifted from the transfer start position T2 determined based on the cueing performed under a different curl condition from the curl condition before the printing is started.

Therefore, in order to offset the shift, the conveyance distance correction unit 35 corrects the conveyance distance of the roll paper 2, thereby substantially matching the transfer start position T1 with the transfer start position T2. Specifically, the curl condition is estimated depending on the progress of the printing, and an additional conveyance is performed based on a shifted distance determined by the estimated curl condition (see (7) in FIG. 6). Parameters for estimating the curl condition can be, for example, as explained above using Equation (1), an image pattern transferred in each color (thermal energy applied to the recording medium), the consumed amount (roll diameter) of the roll paper 2, an internal environment of the printer device 1, and the like, and it is desirable to use some of these parameters to compute the shifted distance.

When the transfer start position T1 is correctly set immediately beneath the thermal head 6 through such a conveyance distance correction, the roll paper 2 is conveyed backward based on the control data, and the third color (cyan) is transferred while pulling the roll paper 2 back toward the upstream side (see (8) in FIG. 6).

The process then moves to the transferring operation of the lamination ink based on the control data (see (9) and (10) in FIG. 6).

As described above, with the printer device 1 according to the embodiment, when the synchronism loss detection sensor 20 detects the loss of synchronism, the conveyance control unit 34 resumes the color printing once interrupted by the loss of synchronism after positioning the roll paper 2 by the cueing and conveying it to the transfer start position. Therefore, even if the stepper motor 16 becomes uncontrollable due to the loss of synchronism during the color printing by thermal transfer, the printing in progress can be continued. That is, the printing operation does not stop even if the loss of synchronism occurs in the stepper motor 16, and the printing result without any color shift can be obtained despite having continued the printing operation in progress. Accordingly, the processing operation after the occurrence of the loss of synchronism in the stepper motor 16 can be performed efficiently, and therefore the user-friendliness is improved. Furthermore, because a stepper motor with less torque margin that is likely to cause the loss of synchronism can be used as the stepper motor 16, a smaller motor can be selected compared with a configuration to issue an error notice or stop the printing operation in response to the loss of synchronism, advantageously resulting in the reduction of the size, the weight, and the production cost of the device.

Furthermore, with the printer device 1 according to the embodiment, conveyance distance correction unit 35 corrects the conveyance distance based on the progress of the color printing on the roll paper 2 when the conveyance control unit 34 sets the roll paper 2 to the transfer start position again in response to the detected loss of synchronism by the synchronism loss detection sensor 20. Accordingly, even if the curl condition of the roll paper 2 is changed by the heating and the curl correction every time a single color is transferred, the shift between the previous transfer start position and the current transfer start position caused by the difference of the curl condition of the roll paper 2 can be offset by the correction. That is, by the conveyance distance correction unit 35 correcting the position depending on the progress of the printing, the transfer start position of the roll paper 2 can be kept to the transfer start position for the first color all the time, thereby continuing the printing in progress without any color shift.

Although the embodiment was explained with reference to a preferable example, the present invention is not limited to the embodiment.

For example, in the embodiment, so-called the pullback printing method is used, in which the printing on the roll paper 2 is performed when the roll paper 2 is pulled back from the transfer start position to the upstream side of the direction in which the roll paper 2 is conveyed. In such a configuration, the distance between the paper position detection sensor 19 and the thermal head 6 tends to be long, and the effect by the curl condition of the roll paper 2 is more likely to be reflected. Therefore, it is highly efficient to correct the conveyance distance when the roll paper 2 is set to the transfer start position in response to the detected loss of synchronism because it can be avoided that the curl condition of the roll paper 2 influences the conveyance distance. However, the embodiment of the present invention is not limited to the pullback printing method, but it can be applied to other methods in the same manner.

The present application contains subject matter related to that disclosed in Japanese Priority Patent Application JP 2009-135667 filed in the Japan Patent Office on Jun. 5, 2009, the entire content of which is hereby incorporated by reference.

As described above, the present invention is not limited to the embodiment described above, and can be modified without departing from the scope of the invention.

What is claimed is:

1. A printing apparatus comprising:

an image transfer unit configured to perform a color printing on a recording medium by thermally transferring a plurality of color materials onto the recording medium in a sequential manner thereby superimposing images in respective color materials;

a medium conveyance unit configured to convey the recording medium using a stepper motor as a drive source so that the recording medium passes through the image transfer unit;

a synchronism loss detection sensor configured to detect an occurrence of a loss of synchronism in the stepper motor;

a reference position detection sensor configured to detect that the recording medium conveyed by the medium conveyance unit is located at a predetermined reference position; and a conveyance control unit configured to make the medium conveyance unit repeat a forward conveyance of the recording medium from a transfer start position located at a predetermined distance from the reference position and a reverse conveyance of the recording medium to the transfer start position for each of the color materials when the image transfer unit performs the color printing, and, if the synchronism loss detection sensor detects the loss of synchronism in a process of the repeating, make the image transfer unit resume the color printing on the recording medium interrupted by the loss of synchronism through positioning the recording medium in the repeating process to the reference position using a detection result of the reference position detection sensor and conveying the recording medium in the repeating process from the reference position to the transfer start position.

2. The printing apparatus according to claim 1, further comprising a conveyance distance correction unit configured to correct a conveyance distance of the recording medium based on a color printing condition of the recording medium at the time of detecting the loss of synchronism when the conveyance control unit conveys the recording medium from the reference position to the transfer start position in response to a detected loss of synchronism by the synchronism loss detection sensor.

3. The printing apparatus according to claim 2, wherein the conveyance distance correction unit corrects the conveyance distance of the recording medium based on an amount of thermal energy supplied from the image transfer unit to the recording medium before the loss of synchronism is detected by the synchronism loss detection sensor.

4. The printing apparatus according to claim 3, wherein the conveyance distance correction unit estimates the amount of thermal energy supplied to the recording medium using an average printing density of each color material thermally transferred by the image transfer unit before the loss of synchronism is detected by the synchronism loss detection sensor.

5. The printing apparatus according to claim 3 or 4, wherein the conveyance distance correction unit estimates the amount of thermal energy supplied to the recording medium using a progress of a thermal transfer of each color material performed by the image transfer unit when the loss of synchronism is detected by the synchronism loss detection sensor.

6. The printing apparatus according to any one of claims 2 to 5, wherein, if the recording medium is supplied from a rolled state, the conveyance distance correction unit corrects the conveyance distance of the recording medium based on a consumed amount in association with the rolled state when the loss of synchronism is detected by the synchronism loss detection sensor.

7. The printing apparatus according to claim 6, wherein, if the image transfer unit thermally transfers the color material from a ribbon-shaped member, the conveyance distance correction unit estimates the consumed amount in association with the rolled state of the recording medium using a detection result of a consumed amount of the ribbon-shaped member.

8. The printing apparatus according to any one of claims 2 to 7, wherein the conveyance distance correction unit corrects the conveyance distance of the recording medium based on a detection result of an environmental condition in the apparatus when the loss of synchronism is detected by the synchronism loss detection sensor.

9. The printing apparatus according to any one of claims 1 to 8, wherein the image transfer unit is configured to thermally transfer each color material to the recording medium when the recording medium is conveyed from the transfer start position toward an upstream side of a direction of conveyance.

* * * * *